United States Patent [19]

Hotomi et al.

[11] Patent Number: 4,950,571

[45] Date of Patent: Aug. 21, 1990

[54] PHOTOSENSITIVE MEMBER COMPOSED OF CHARGE TRANSPORTING LAYER AND CHARGE GENERATING LAYER

[75] Inventors: Hideo Hotomi, Suita; Izumi Osawa, Ikeda; Mitsutoshi Nakamura, Osaka; Shuji Iino, Hirakata, all of Japan

[73] Assignee: Minolta Camera Kabushiki Kaisha, Osaka, Japan

[21] Appl. No.: 373,603

[22] Filed: Jun. 30, 1989

Related U.S. Application Data

[63] Continuation of Ser. No. 35,508, Apr. 7, 1987, abandoned.

[30] Foreign Application Priority Data

Apr. 9, 1986 [JP] Japan ..... 61-83130
Apr. 9, 1986 [JP] Japan ..... 61-83131

[51] Int. Cl.[5] ..... G03G 5/14
[52] U.S. Cl. ..... 430/58; 430/66
[58] Field of Search ..... 430/58, 60, 66

[56] References Cited

U.S. PATENT DOCUMENTS

| | | | |
|---|---|---|---|
| 4,675,265 | 6/1987 | Kazmma et al. | 430/66 X |
| 4,738,912 | 4/1988 | Iino et al. | 430/58 |
| 4,741,982 | 5/1988 | Iino et al. | 430/58 |
| 4,743,522 | 5/1988 | Iino et al. | 430/58 |
| 4,749,636 | 6/1988 | Iino et al. | 430/58 |
| 4,755,444 | 7/1988 | Karakida et al. | 430/66 |

FOREIGN PATENT DOCUMENTS

| | | | |
|---|---|---|---|
| 56-62254 | 5/1981 | Japan . | |
| 60-67955 | 4/1985 | Japan | 430/66 |
| 1174171 | 12/1989 | United Kingdom . | |

OTHER PUBLICATIONS

*A Review of Recent Advances in Plasma Polymerization*, by Shen and Bell, Department of Chemical Engineering, U. of California, Berkley CA 94720.

"Properties of Diamond-Like Carbon Films", *Thin Solid Films*, vol. 119, pp. 121-126, 1984.

"Electronic Properties of Substitutionally Doped Amouphous Si and Ge", *Philisophical Magazine*, vol. 33, No. 6, pp. 935-949, 1976.

"Photosensitive Materials for Electron Photography-OPC vs. Inorganics", *Nikkei New Materials*, Dec. 15, 1986.

*Primary Examiner*—Roland E. Martin
*Attorney, Agent, or Firm*—Burns, Doane, Swecker & Mathis

[57] ABSTRACT

The present invention relates to a photosensitive member having an a-C layer as a charge transporting layer, which a-C layer is specified in the ratio of the number of saturated carbon bonding with hydrogen to the number of saturated carbon not bonding with hydrogen or in the ratio of the number of unsaturated carbon bonding with hydrogen to the number of unsaturated carbon not bonding with hydrogen; the photosensitive member has an excellent charge transportability as well as a chargeability.

7 Claims, 4 Drawing Sheets

PHOTOSENSITIVE MEMBER COMPOSED OF CHARGE TRANSPORTING LAYER AND CHARGE GENERATING LAYER

This application is a continuation, of application Ser. No. 035,508, filed Apr. 7, 1987, now abandoned.

BACKGROUND OF THE INVENTION

This invention relates to a photosensitive member and, more particularly, to a photosensitive member in electrophotography.

Recently there has been used an amorphous silicon produced by a plasma vapor deposition (referred to as a plasma-CVD hereinafter) for a photosensitive member, especially for electrophotography.

The photosensitive material a-Si has various splendid properties. However, its use raises a problem that, because of a large specific inductive capacity epsilon of approximately 12, a-Si essentially needs to form a film with a minimum thickness of approximately 25 microns in order for the photosensitive member to have a sufficient surface potential.

The production of a-Si photosensitive members by the plasma CVD process is a time-consuming operation with the a-Si film formed at a slow rate of deposition, and, moreover, the more difficult it becomes to obtain a-Si films of uniform quality, the longer it takes for the films to be formed. Consequently, there is a high probability that an a-Si photosensitive member in the use causes defects in images, such as white spot noise, besides other defects including an increase in cost of the raw material.

In any attempt for improvement that has been made concerning the above-mentioned defects, it was essentially undesirable to make the film thickness smaller than the minimum mentioned above.

Furthermore, the a-Si photosensitive material exhibits defects in adhesivity to the substrate, in corona resistance and resistance to environment and also chemicals.

As an answer to the problems described above, it has been proposed to provide an a-Si photosensitive layer with an overcoating layer or an undercoating layer of an organic plasmapolymerized film: examples describing the overcoating were announced in Japanese Pat. KOKAI Nos. 61761/1985, 214859/1984, 46130/1976, U.S. Pat. No. 3,956,525, etc. and those describing the undercoating in Japanese Pat. KOKAI Nos. 63541/1985, 136742/1984, 38753/1984, 28161/1984, 60447/1981, etc.

As other prior art disclosing an application of plasma polymerization there are known Japanese Pat. KOKAI Nos. 148326/84, 60447/81, and 120527/78.

It is known that an organic plasma-polymerized film can be made from any of gaseous organic compounds, such as ethylene gas, benzene and aromatic silane, (one reference in this respect is the Journal of Applied Polymer Science 1973, 17 (885–892) contributed by A.T. Bell, M. Shen et al.), but any such organic plasma-polymerized film produced by a conventional method has been in use only where its insulation property is required to be good. Films of this kind have been regarded as insulators having electrical resistance of approximately $10^{16}$ohm cm, such as an ordinary polyethylene film, or at the least as materials practically similar to an insulator in the application.

The Japanese Pat. KOKAI No. 61761/1985 made public a photosensitive member coated with a surface protective layer which is a carbon insulation film resembling diamond with a film thickness of 500 angstrom - 2 microns. This thin carbon film is designed to improve a-Si photosensitive members with respect to their resistance to corona discharge and mechanical strength. The polymer film is very thin and an electric charge passes within the film by a tunnel effect, the film itself not needing an ability to transport an electric charge. The publication lacked a description relating to the carrier-transporting property of the organic plasma-polymerized film and the topic matter failed to provide a solution to the essential problems of a-Si in the foregoing description.

The Japanese Pat. KOKAI No. 214859/1984 made public the use of an overcoating layer of an organic transparent film with thickness of approximately 5 microns which can be made from an organic hydrocarbon monomer, such as ethylene and acetylene, by a technique of plasma polymerization. The layer described therein was designed to improve a-Si photosensitive members with respect to separation of the film from the substrate, durability, pinholes, and production efficiency. The publication lacked a description of a carrier-transporting property of the organic plasma-polymerized film and failed to provide a solution to the essential problems of a-Si in the foregoing description.

The Japanese Pat. KOKAI No. 46130/1976 made public a photosensitive member utilizing n-vinylcarbazole, wherein an organic plasma-polymerized film with thickness of 3 microns - 0.001 microns was formed at the surface by a technique of glow discharge. The purpose of this technique was to make bipolar charging applicable to a photosensitive member of poly-n-vinylcarbazole, to which otherwise only positive charging had been applicable. The plasma-polymerized film is produced in a very thin layer of 0.001 microns - 3 microns and used by way of overcoating. The polymer layer is very thin, which is not considered necessary if it had that ability for to transport an electric charge. The publication lacked a description of a carrier transporting property of the polymer layer and failed to provide a solution to the essential problems of a-Si in the foregoing description.

The U.S. Pat. Publication USP No. 3,956,525 made public a technique whereby on a substrate a layer of a sensitizer is laid and thereupon a layer of an organic photoconductive electric insulator is superimposed and the laminate is overlaid by a polymer film 0.1 micron - 1 micron thick formed by glow discharge. This film is designed to protect the surface so as to make the photosensitive members resistant to wet developing and therefore used by way of overcoating. The polymer film is very thin and does not need an ability to transport an electric charge. The publication lacked a description of a carrier transporting property of the polymer film and failed to provide a solution to the essential problems of a-Si in the foregoing description.

The Japanese Pat. KOKAI No. 63541/1985 made public a photosensitive member wherein an a-Si layer is undercoated by an organic plasma-polymerized film resembling diamond with a thickness of 200 angstrom to 2 microns. The organic plasma-polymerized film is designed to improve the adhesivity of the a-Si layer to the substrate. The polymer film can be made very thin and an electric charge passes within the film by a tunnel effect, the film itself does not need an ability to transport an electric charge. The publication lacked a description relating to the carrier transporting property of the organic plasma-polymerized film and the topic matter failed to provide a solution to the essential problems of a-Si in the foregoing description.

The Japanese Pat. KOKAI No. 28161/1984 made public a photosensitive member wherein on a substrate an a-Si film is laid and thereupon an organic plasma-polymerized film is superimposed. The organic plasma-polymerized film is used as an undercoat, the insulation property thereby being utilized, and also has the functions of blocking, improving the adhesivity, or preventing the separation of the photosensitive coat.

The polymer layer may be very thin (e.g. less than 5 micron meter, preferably less than 1 micron meter). Such a thin layer does not cause any problems such as increase of surface potential (residual potential) even if it has insufficient charge transportability, because the residual potential is controlled at a lower level by the increase of the electric potential at an undercoat layer by repeated use and the enlargement of carrier passage thereby (tunnel effect). Therefore, this polymer layer can be used as an undercoat layer but cannot be used as a carrier transporting layer.

Further, this prior art does not refer carrier transportability of an a-C layer, and does not solve the essential problem caused by an a-Si as aforementioned.

The Japanese Pat. KOKAI No. 38753/1984 made public a technique whereby an organic plasma polymerized thin film with a thickness of 10–100 angstrom is formed from a mixed gas composed of oxygen, nitrogen and a hydrocarbon, by a technique of plasma polymerization and thereupon an a-Si layer is formed. Said organic plasma-polymerized film is used as an undercoat utilizing the insulation property of the polymer and also has the functions of blocking or preventing the separation of the photosensitive coat. The polymer film can be made very thin and an electric charge passes within the film by a tunnel effect, the film itself not needing an ability to transport an electric charge. The publication lacked a description of a carrier transporting property of the organic plasma-polymerized film and failed to provide a solution to the essential problems of a-Si in the foregoing description.

Japanese Pat. KOKAI No. 148326/81 discloses a production of a plasma-CVD thin layer comprising a pre-decomposition of gas and a pre-polymerization. However, Si compounds are only exemplified in the Examples.

The Japanese Pat. KOKAI No. 136742/1984 described a semiconductor device wherein on a substrate an organic plasma-polymerized layer with thickness of approximately 5 microns was formed and thereon a silicon layer was superimposed. Said organic plasma-polymerized layer was designed to prevent the aluminum, the material forming the substrate, from diffusing into the a-Si, but the publication lacked description relating to the method of its fabrication, its quality, etc. The publication also lacked a description relating to the carrier transporting property of the organic plasma-polymerized layer and the topic matter failed to provide a solution to the essential problems of a-Si in the foregoing description.

The Japanese Pat. KOKAI No. 60447/1981 made public a method of forming an organic photoconductive layer by plasma polymerization. The publication lacked description relating to the applicability of the invention to electrophotography. The description in the publication dealt with said layer as a charge generating layer or a photoconductive layer and the invention described thereby differs from the present invention. The topic matter failed to provide a solution to the essential problems of a-Si in the foregoing description.

Japanese Pat. KOKAI No. 120527/78 discloses a production of a posi-type radial sensitive layer by a plasma polymerization of hydrocarbon and halogenized hydrogen. This is a production of posi-type resist material by cross-linkage using an electron-ray, X-ray, λ-ray or α-ray, which is not applied to an electrophotosensitive member.

As aforementioned in the field of photosensitive member the a-C layer has been used for an undercoat layer or an overcoat layer, which does not need a carrier transportability, and is used under the recognition that the organic polymer film is an insulator. Therefore, the film is only used as a thin film at most 5 micron meter or so, and a carrier passes through the film due to a tunnel effect. Where the tunnel effect cannot be expected, the film can be used only at such a thin thickness that a residual potential is practically negligible.

SUMMARY OF THE INVENTION

The primary object of this invention is to provide a photosensitive member which is free from the above-mentioned defects, good in electric charge-transporting properties and electrical chargeability, and ensures formation of satisfactory images.

Another object of this invention is to provide a photosensitive member which is capable of assuming a sufficient surface potential even when the thickness of the layer is small.

Another object of this invention is to provide a photosensitive member which can be fabricated at low cost and in a short time.

Another object of this invention is to provide a photosensitive member which has an amorphous carbon layer (referred to as an a-C layer hereinafter) which is good in resistances to corona discharge, acids, humidity and heat, and in stiffness.

These objects and other related objects can be accomplished by providing a photosensitive member which comprises an electrically conductive substrate, a charge generating layer, and a charge transporting layer comprising amorphous carbon containing hydrogen, in which the saturated carbon and unsaturated carbon exist in a specific ratio.

DETAILED DESCRIPTION OF THE INVENTION

Figure 1:
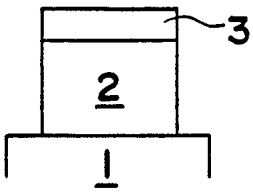
FIGS. 1 through 12 illustrate photosensitive members embodying the present invention in schematic cross sectional representation.

The first object of the present invention is to provide a photosensitive member comprising:

an electrically conductive substrate;

a charge generating layer; and a charge transporting layer essentially consisting of an amorphous carbon layer containing hydrogen, in which the ratio of the number of saturated carbon bonding with hydrogen ($n_1$) to the number of saturated carbon not bonding with hydrogen ($n_2$) is from 1:0.5 to 1:0.14.

The second object of the present invention is to provide a photosensitive member comprising:

an electrically conductive substrate;

a charge generating layer; and a charge transporting layer essentially consisting of an amorphous carbon layer containing hydrogen, in which the ratio of the number of unsaturated carbon ($n_3$) bonding with hydrogen to the number of unsaturated carbon not bonding with hydrogen ($n_4$) is from 1:4 to 1:0.2.

A photosensitive member according to the present invention essentially consists of at least a charge generating layer and a charge transporting layer.

The charge transporting layer is composed of an amorphous carbon layer (a-C layer) containing hydrogen. The hydrogen content of the a-C layer is 20–67 atomic %, preferably 40–67 atomic %, most preferably 45–65 atomic %. If the hydrogen content is less than 20 atomic %, a sufficient transportability cannot be obtained, whereas being more than 67 atomic %, the properties and productivity of the a-C layer lower.

The a-C layer of the present invention contains carbon atoms having various kinds of bond such as single bond (free radical), double bond or triple bond, and some of them are bonded with hydrogen and others are not bonded with hydrogen.

It is possible to determine whether the carbon atoms in the a-C layer have unsaturated bonds or not, and the number thereof may be analyzed either by an IR spectrum analysis, nuclear magnetic resonance by proton ($^1$H-NMR) or nuclear magnetic resonance by $^{13}$C ($^{13}$C-NMR) or combination thereof.

In the present invention an unsaturated bond means a double bond of carbon-carbon and/or a triple bond of carbon-carbon.

In the first embodiment of the present invention, in a saturated carbon of an a-C layer, the ratio of the number of carbon atoms bonding with hydrogen ($n_1$) to the number of carbon atoms not bonding with hydrogen ($n_2$) is 1:0.5 to 1:0.14, wherein the saturated carbon include neo-carbon radical ("neo-carbon radical" means a carbon atom bonding four other carbon atoms), methine radical, methylene radical or methyl radical. The a-C layer is suitable as a photosensitive member in case that, when assuming $n_1$ is 1, $n_2$ is 0.14 to 0.5, more preferably 0.17 to 0.4, and most preferably 0.2 to 0.3. If $n_2$ is less than 0.14 the a-C layer becomes a high electroresistible layer containing methine radical, methylene radical or methyl radical in a comparatively large amount, so that a suitable transportability cannot be obtained. A photosensitive member having such a layer as a charge transporting layer hardly shows photosensitivity so as to become worse in a carrier injection and a transportability. On the other hand, if the $n_2$ is larger than 0.5, neo-carbon radical comparatively increases so as to reduce the resistance of the layer , so that a photosensitive member having such a layer as a charge transporting layer cannot give a sufficient charge potential. Even if the amount of charge is increased or a barrier is provided to forcibly give a charging potential, the injection of the charge and transportability lower, and so a photosensitive member exhibits poor sensitivity. In general, when the value of n2 is more than 0.14 (as $n_1$ is 1), the specific resistance becomes more than about $10^{11}$ ohms.cm, and the mobility of the carrier increases to about $10^{-7}$ cm$^2$/(V.sec.) or more to give an excellent charge transportability.

In the second embodiment of the present photosensitive member, in the carbon having unsaturated bonds, the ratio of the number of carbon atoms bonding with hydrogen atoms ($n_3$) to the number of carbon atoms not bonding with hydrogen atoms ($n_4$) is 1:4 to 1:0.2. The a-C layer is suitable for a charge transporting layer in case that, when assuming $n_3$ is 1, $n_4$ is from 4 to 0.2, preferably from 2 to 0.5, and most preferably from 1.25 to 0.88. If the $n_4$ is more than 4, though the chargeability increases, the photosensitive member exhibits poor electrophotographic properties due to the reduction of photosensitivity. If the $n_4$ is less than 0.2, the chargeability of the photosensitive member reduced, so that the photosensitivity is almost lost. If the ratio of n3:$n_4$ is controlled within 1:4 to 1:0.2 the specific resistance of a-C layer becomes more than about $10^{11}$ ohms.cm, and the mobility of the carrier increases to about $10^{-7}$ cm$^2$/(V.sec.) or more to give an excellent charge transportability.

The number of the whole carbon atoms in the a-C layer of the present invention is determined from the result of an element analysis and a specific gravity thereof. Given $C_xH_y$ ($x+y=1$) as the ratio of C to H in the analysis, and W (g/cm$^3$) as the specific gravity of the a-C layer, the number of the whole carbon atoms in 1 cm$^3$ of the a-C layer (Cc) can be calculated from the following equation:

$$Cc = \frac{AWx}{12x + y} \text{ (per/cm}^3\text{)} \quad \text{(I)}$$

wherein Cc is the number of the whole carbon atoms, W is a specific gravity, x and y are analytical data of carbon and hydrogen respectively, and A is Avogadro's number (per/mol).

In the first embodiment an a-C layer having the number of saturated carbon atoms of 40 to 90% based on the whole number of carbon atoms is preferable.

In the second embodiment an a-C layer having the number of unsaturated carbon atoms of 5 to 50% based on the whole number of carbon atoms is preferable.

The thickness suitable for an a-C layer ranges 5–50 microns, the preferable range being 7–30 microns. The surface potential becomes lower and the images can not be copied in a sufficient density if the thickness is below 5 microns, whereas the productivity is impaired if the thickness exceeds 50 microns. An a-C layer exhibits good transparency and a relatively high dark resistance, and has such a good charge transporting property that, even when the layer thickness exceeds 5 microns as described above, it transports the carrier without causing a charge trap.

Organic compounds for the production of a-C layer may not be always gas, but may be liquid or solid materials providing that the materials can be vaporized through melting, vaporization, sublimation, or the like when heated or vacuumed.

A hydrocarbon for this purpose may be selected from among, for example, methane series hydrocarbons, ethylene series hydrocarbons, acetylene series hydrocarbons, alicyclic hydrocarbons, aromatic hydrocarbons, etc. The mixture thereof may be used. Further, these hydrocarbons can be mixed.

Examples of the methane series hydrocarbons applicable in this respect are:

normal-paraffins—methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; and isoparaffins—isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, triptane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.

Examples of the ethylene series hydrocarbons applicable in this respect are:

olefins—ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene, etc.;

diolefins—allene, methylallene, butadiene, pentadiene, hexadiene, cyclopentadiene, etc.; and triolefins—ocimene, allo-ocimene, myrcene, hexatriene, etc.

Examples of the acetylene series hydrocarbons applicable in this respect are:

acetylene, methylacetylene, 1-butyne, 2-butyne, 1-pentyne, 1-hexyne, 1-heptyne, 1-octyne, 1-nonyne, and 1-decyne.

Examples of the alicyclic hydrocarbons applicable in this respect are:

cycloparaffins—cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, etc.;

cycloolefins—cyclopropene, cyclobutene, cyclopentene, cyclohexene, cycloheptene, cyclcoctene, cyclononene, cyclodecene, etc.;

terpenes—limonene, terpinolene, phellandrene, silvestrene, thujene, caren, pinene, bornylene, camphene, fenchene, cyclofenchene, tricyclene, bisabolene, zingiberene, curcumene, humulene, cadine-sesquibenihen, selinene, caryophyllene, santalene, cedrene, camphorene, phyllocladene, podocarprene, mirene, etc.; and steroids.

Examples of the aromatic hydrocarbons applicable in this respect are:

benzene, toluene, xylene, hemimellitene, pseudocumene, mesitylene, prehnitene, isodurene, durene, pentamethyl benzene, hexamethyl benzene, ethylbenzene, propyl benzene, cumene, styrene, biphenyl, terphenyl, diphenylmethane, triphenylmethane, dibenzyl, stilbene, indene, naphthalene, tetralin, anthracene, and phenanthrene.

When the a-C layer is formed according to the present invention, two kinds of the above organic compounds or more may be co-used as a mixture. Various kinds of copolymer (block copolymer, graft copolymer and so on) are produced in the a-C layer so as to improve the hardness and adhesive property. If an alkane hydrocarbon ($C_nH_{2n+2}$) is used, i-C layer, which has a Vickers hardness of not less than 2000, i.e. diamond like supper hardness, and an electric resistance of $10^9$ ohm.cm can be obtained. However, in this case as a plasma condition a high temperature, lower pressure and high power must be employed with the application of direct bias to the substrate.

As a carrier gas, inert gas such as $H_2$, Ar, N, He and the like is suitable.

In order to produce the a-C layer of the present invention various kinds of plasma method such as direct current, high frequency, low frequency or micro wave plasma method are applicable. As stated hereinafter the combination of an electromagnetic wave (X-ray, laser light etc.) with the plasma method is also applicable. According to the selection of the above methods various i-C layers different in properties can be obtained from the same monomer. For instance, using low frequency plasma method (frequency is from tens Hz to hundreds KHz), a-C layer having a high hardness can be obtained.

In the case that the charge generating layer is formed by the high frequency plasma or P-CVD, a-C layer is preferably formed by a method similar to the above in the aspect of device cost and process saving.

The charge generating layer of a photosensitive member according to the invention is not restricted to any particular materials; the layer may be produced by, for example, amorphous silicon (a-Si) (which may contain hetero elements, e.g., H, C, 0, S, N, P, B, a halogen, and Ge to change the property, and also may be a multilayer), Se, Se-As, Se-Te, CdS, or a resin containing inorganic substances such as a copper phthalocyanine and zinc oxide and/or organic substances such as a bisazo pigment, triallylmethane dye, thiazine dye, oxazine dye, xanthene dye, cyanine colorant, styryl colorant, pyrilium dye, azo pigment, quinacridone pigment, indigo pigment, perylene pigment, polycyclic quinone pigment, bis-benzimidazole pigment, indanthrone pigment, squalelum pigment, and phthlocyanine pigment.

In the present invention phthalocyanine pigments may be used as a charge generating material. The phthalocyanines may be vapor depositable, and may include monochloroaluminum monochlorophthalocyanine (AlClPc(Cl)), titanil phthalocyanine (TiOPc), metal free phthalocyanine ($H_2Pc$), aluminum monochlorophthalocyanine (AlClPc), zinc phthalocyanine (ZnPc), magnesium phthalocyanine (MgPc) and the like.

Inorganic compounds used as a charge generating materials may include $Al_2O_3$, CaO, CeO, $CeO_2$, CdO, $Cr_2O_3$, CuO, $Cu_2O$, $Fe_2O_3$, $In_2O_3$, MgO, $MnO_2$, $MoO_3$, NiO, PbO, SiO, $SiO_2$, $SnO_2$, $Ta_2O_5$, TiO, $TiO_2$, $Ti_2O_3$, $WO_3$, $Y_2O_3$, ZnO, $ZrO_2$, ZnS, CdS, CdSe, CdTe, PbS, ZnSe, $MgF_2$ and the like.

In order to achieve the objects of the present invention more effectively, AlClPc(Cl), TiOPc or $H_2Pc$ as a phthalocyanine pigments, and ZnS, $Al_2O_3$ or SiO as an inorganic compound may be used in combination. Examples of the most preferable combinations are AlClPc(Cl) with ZnS, and TiOPc with ZnS.

Besides the examples mentioned above, the charge generating layer may be of any material that is capable of absorbing light and generating a charge carrier with a very high efficiency.

The charge generating layer may be produced by a conventional method, for example, a method of coating a suitable binder resin dispersing the powder of the above materials, plasma method and the like. If the charge transporting layer is formed by the plasma method, it is preferable to produce the charge generating layer by the plasma method because of the device cost and the process saving. In the case that the charge generating layer is produced by a conventional method, it is preferable to use the aforementioned inorganic materials, dyes or pigments which are previously coated with an organic material by plasma polymerization. When these inorganic materials, dyes or pigments are dispersed in a resin, dispersibility, resistivity to a solvent, and prevention of spoilage will be achieved.

A charge generating layer according to the invention can be formed at any position in a photosensitive member, that is, for example, it can be formed at any of the top-most, intermediate and lowest layers. The thickness of the layer must in general be set such that a light of 550 nm can be absorbed 90% or more, though depended on the kind of the material used, especially its spectral absorption characteristic, light source for exposure, purpose, etc. With a-Si as the material the thickness must be within the range of 0.1–3 microns.

To adjust the charging property of an a-C charge transporting layer in invention, heteroatoms, other than carbon and hydrogen, can be incorporated into the material constituting said a-C charge transporting layer. For example, to promote the transporting characteristic of the hole, atoms in Group III in the periodic table or halogen atoms can be incorporated. To promote the transporting characteristic of the electron, atoms in Group V in the periodic table or alkali metal atoms can be incorporated. To promote the transporting characteristic of both positive and negative carriers, atoms of Si, Ge, an alkali earth metal, or an chalcogen can be incorporated. These additive atoms can be used in a plurality of kinds together, at some specific positions in a charge transporting layer according to the purpose, and can have a density gradient, or in some other specific manner.

FIGS. 1 through 12 illustrate embodiments of the present invention, each in schematic sectional representation of models, wherein (1) denotes a substrate, (2) an a-C layer as a charge transporting layer, and (3) a charge generating layer. When a photosensitive member of the model shown in FIG. 1 is positively charged and then exposed to image light, a charge carrier is generated in the charge generating layer (3) and the electron neutralizes the surface charge while the positive hole is transported to the substrate (1) under guarantee of a good charge-transporting charcteristic of the a-C layer (2). When the photosensitive member shown in FIG. 1 is negatively charged, contrarily the electron is transported through the a-C layer (2).

Figure 2:
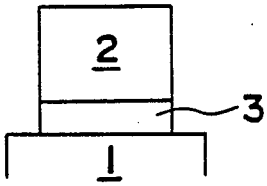

The photosensitive member illustrated in FIG. 2 is an example wherein an a-C layer (2) forms the topmost layer. When it is positively charged, the electron is transported through the a-C layer (2) and, when negatively charged, the hole is transported through the a-C layer (2).

Figure 3:
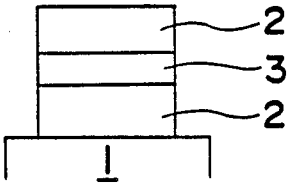

FIG.3 illustrates an embodiment of a photosensitive member of the present invention, in which on a substrate (1) a charge transporting layer (2), a charge generating layer (3) and then a charge transporting layer (2) are formed in this order.

Figure 4:
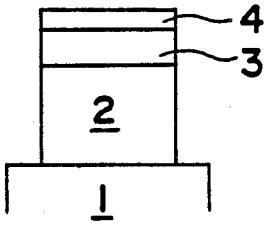
Figure 5:
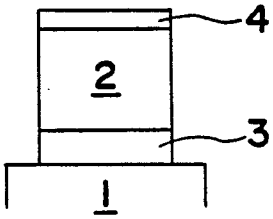
Figure 6:
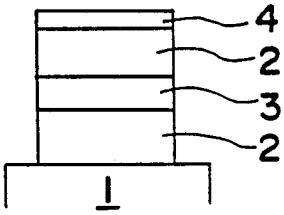

FIGS. 4 through 6 illustrate the same photosensitive members as FIGS. 1 through 3, except that each additionally has a surface-protective overcoat (4) with thickness in the range of 0.01–5 microns, which, in keeping with the operating manner of the respective photosensitive member and the environment where it is used, is designed to protect the charge generating layer (3) or the charge transporting a-C layer (2) and to improve the initial surface potential as well. Any suitable material in public knowledge can be used to make the surface protective layers. It is desirable, in the practice of this invention, to make them by a technique of organic plasma polymerization from the viewpoint of manufacturing efficiency, etc. An a-C layer embodying the invention can also be used for this purpose. Heteroatoms, when required, can be incorporated into the protective layer (4).

Figure 7:
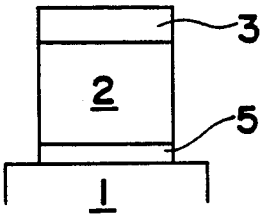
Figure 8:
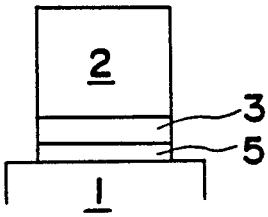
Figure 9:
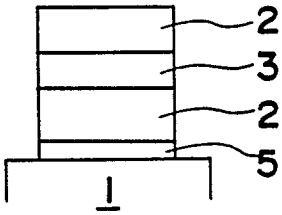
Figure 10:
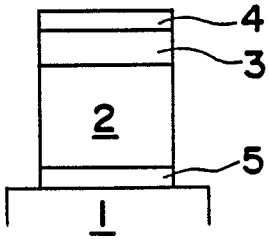
Figure 11:
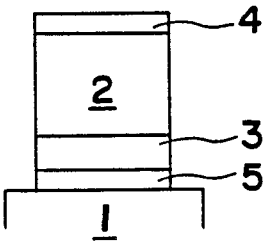
Figure 12:
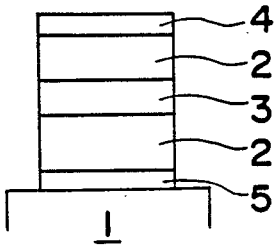

FIGS. 7 through 9 illustrate the same photosensitive members as FIGS. 1 through 3, except that each additionally has an undercoat (5) with a thickness in the range of 0.01–5 microns which functions as an adhesion layer or a barrier layer. Depending on the substrate (1) or the process which it undergoes, this undercoat helps adhesion and prevents injection. Any suitable material in public knowledge can be used to make the undercoat. In this case, too, it is desirable to make them by a technique of organic plasma polymerization. An a-C layer according to the present invention can also be used for the purpose. The photosensitive members shown by FIGS. 7 through 9 can also be provided with an overcoat (4) as illustrated by FIGS. 4 through 6 (see FIGS. 10 through 12).

In the embodiments that the a-C layer is formed on the top surface as shown in FIGS. 2, 3, 8 or 9, the surface properties may be improved by the radiation of plasma of oxygen, hydrogen, inert gases, gases for a dry-etching (e.g. halogenized carbons) and/or nitrogen etc. By this treatment the anti-moisture, resistance to rubbing and chargeability can be more improved.

A photosensitive member of the present invention has a charge generating layer and a charge transporting layer. Therefore the production requires at least two processes. When, for example, an a-Si layer produced by equipment for glow discharge decomposition is used as the charge generating layer, the same vacuum equipment can be used for plasma polymerization, and it is naturally preferable in such cases to produce the a-C charge transporting layer, the surface-protective layer, the barrier layer, etc., by plasma polymerization.

It is preferable, in the present invention, that the charge transporting layer of the photosensitive member is produced by the so-called plasma-polymerizing reaction, that is, for example:

molecules in the vapor phase undergo discharge decomposition under reduced pressure and produce a plasma atmosphere, from which active neutral seeds or charged seeds are collected on the substrate by diffusing, electrical or magnetic guiding, etc. and deposited as a solid on the substrate through recombination reaction.

Figure 13:
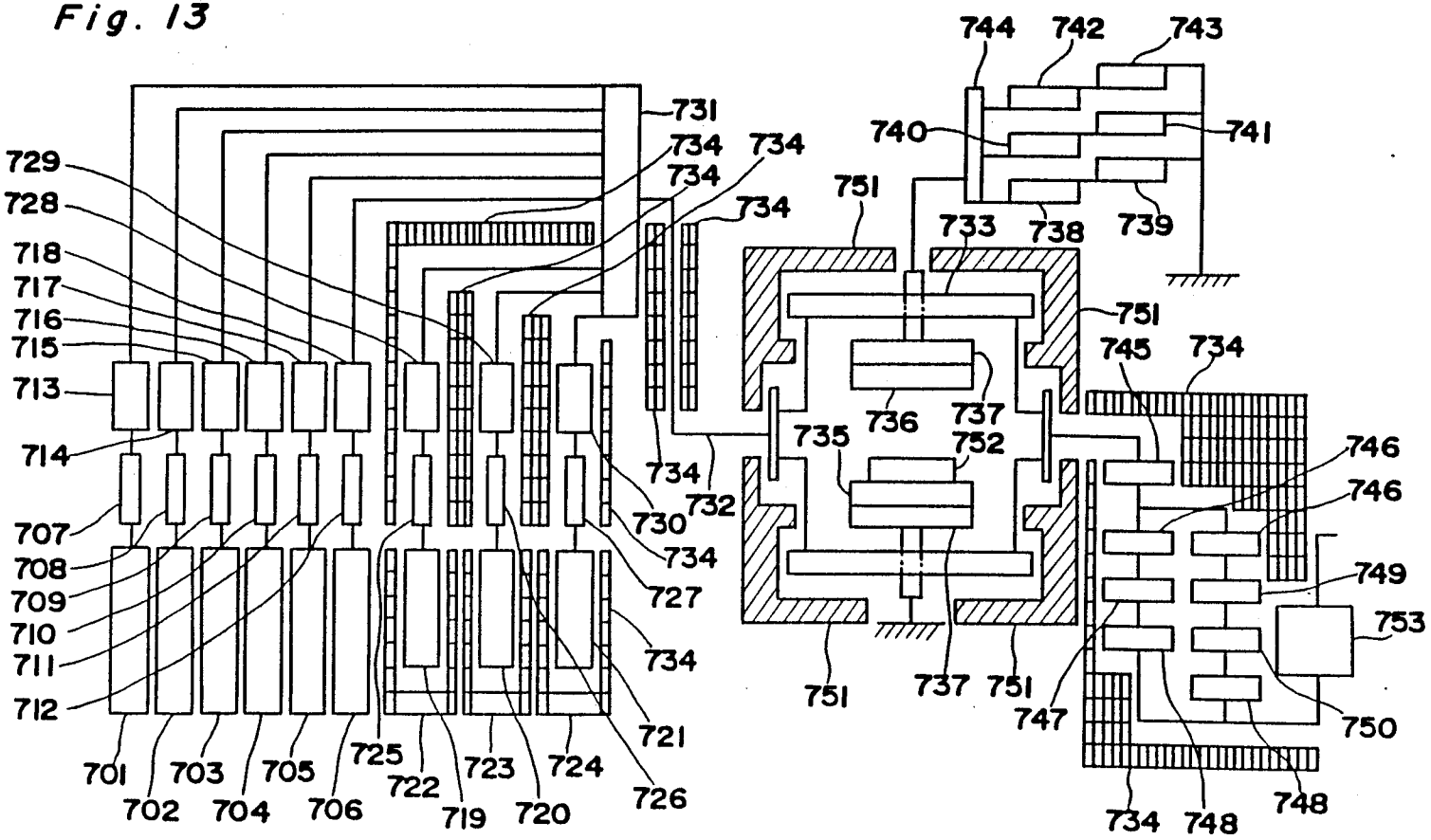
FIGS. 13 and 14 illustrate examples of equipment for fabricating photosensitive members embodying the invention.

FIG. 13 illustrates an equipment for the production of a photosensitive member of the present invention, which is a capacitive coupling type plasma CVD equipment. Exemplifying a photosensitive member having a plasma polymerized polyethylene layer as a charge transporting layer, the production thereof is explained according to FIG. 13.

In FIG. 13, the numerals (701)–(706) denote No. 1 tank through No. 6 tank which are filled with a feedstock (a compound in the vapor phase at normal temperatures) and a carrier gas, each tank connected with one of six regulating valves No. 1 through No. 6 (707)–(712) and one of six flow controllers No. 1 through No. 6 (713)–(718).

(719)–(721) show vessels No. 1 through No. 3 which contain a feedstock which is a compound either in the liquid phase or in the solid phase at normal temperatures, the temperature of each vessel being capable of being controlled to, for example, a room temperature to 150° C. or from −50° C. to a room temperature by means of one of three heaters No. 1 through No. 3 (722)-(724). Each vessel is connected with one of three regulating valves No. 7 through No. 9 (725)-(727) and also with one of three flow controllers No. 7 through No. 9 (728)-(730).

These gases are mixed in a mixer (731) and sent through a main pipe (732) into a reactor (733). The piping is equipped at intervals with pipe heaters (734) so that the gases that are vaporized forms of the feedstock compounds in the liquid or solid state at normal temperatures are prevented from condensing or congealing in the pipes.

In the reaction chamber, there are a grounding electrode (735) and a power-applying electrode (736) installed oppositely, each electrode with a heater (737) for heating the electrode.

Said power-applying electrode is connected to a high frequency power source (739) with a matching box (738) for high frequency power interposed in the connection circuit, to a low frequency power source (741) likewise with a matching box (740) for low frequency power, and to a direct current power source (743) with a low-pass filter (742) interposed in the connection circuit, so that by a connection-selecting switch (744) the mechanism permits application of electric power with a different frequency.

The pressure in the reaction chamber can be adjusted by a pressure control valve (745), and the reduction of the pressure in the reaction chamber can be carried out through an exhaust system selecting valve (746) and by operating a diffusion pump (747) and an oil-sealed rotary vacuum pump (748) in combination or by operating a cooling-elimination device (749), a mechanical booster pump (750) and an oil-sealed rotary vacuum pump in combination.

The exhaust gas is discharged into the ambient air after conversion to a safe unharmful gas by a proper elimination device (753).

The piping in the exhaust system, too, is equipped with pipe heaters at intervals in the pipe lines so that the gases which are vaporized forms of feedstock compounds in the liquid or solid state at normal temperatures are prevented from condensing or congealing in the pipes.

For the same reason the reaction chamber, too, is equipped with a heater (751) for heating the chamber, and an electrode therein are provided with a conductive substrate (752) for the purpose.

FIG. 13 illustrates a conductive substrate (752) fixed to a grounding electrode (735), but it may be fixed to the power-applying electrode (736) and to both the electrodes as well.

Figure 14:
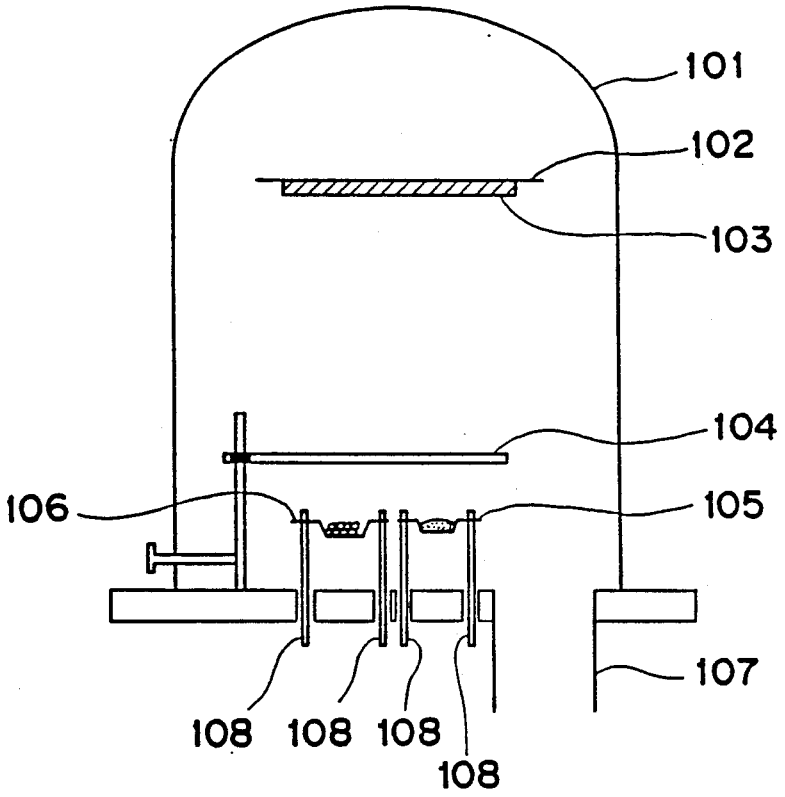

FIG. 14 is a schematic view of a resistance-heating type vapor deposition equipment for a preparation of charge generation layer by a vacuum vapor deposition.

The equipment includes vacuum chamber (101), substrate holder (102), substrate (103), shutter (104), boats (105) and (106), outlet for discharge (107) and electrodes (108).

The charge generating layer of the present invention may be made by the following processes.

The boats (105) and (106) which contain phthalocyanine pigments and inorganic compounds respectively are set up to the electrodes (108), and the substrate (103) is to the substrate holder (102). The vacuum chamber (101) is vacuumed through the outlet (107) by a vacuum pump (not illustrated in FIG. 14). The amount of the materials deposited on the substrate (103) from the boats (105) and (106) can be controlled by the shutter (104). A shield (not shown in FIG. 14) may be provided between the boats (105) and (106) to prevent mutual influence in the temperature of the each boat.

The condition of the vapor deposition such as the degree of the vacuum pressure, boat temperature, evaporation time, amount of pigments and inorganic compounds and others may be selected according to a variation of a charge generating layer, a thickness thereof, a ratio of the pigments to the inorganic compounds and others for a desired charge generating layer.

A charge generating layer and a charge transporting layer can be continuously formed by incorporating a vapor deposition equipment as shown in FIG. 14 into a glow discharge decomposition equipment as shown in FIG. 13.

With reference to FIG. 13 again, the reaction chamber for the production of photosensitive member is preliminarily decreased to a level in the range of about $10^{-4}$ to $10^{-6}$ Torr by the diffusion pump, the degree of vacuum is checked, and then the gas absorbed in the equipment is removed. Simultaneously, by the heater for electrode, the electrode and the conductive substrate fixed to the opposing electrode are heated to a given temperature.

Then, from six tanks, No.1 through No. 6, and from three vessels, No. 1 through No.3, gases of the raw materials are led into the reaction chamber by regulating the gas flows at constant rates using the nine flow controllers, No. 1 through No. 9 and simultaneously the pressure in the reaction chamber is reduced constantly to a specified level by a pressure regulating valve.

After the gas flows have stabilized, the connection-selecting switch is put in position for, for example, the high frequency power source so that high frequency power is supplied to the power-applying electrode. An electrical discharge begins between the two electrodes and an a-C layer in the solid state is formed on the conductive substrate with time.

In the above constitution, for example, when the photosensitive member shown in FIG. 1 is produced, after the reaction chamber (733) is controlled to a given vacuum state, $C_2H_4$ gas from No. 1 tank (701) and $H_2$ gas as carrier gas from No. 2 tank (702) are supplied through the gas line (732). On the other hand, an electric power (e.g. 10 watts -1 K watts) is applied to the upper electrode (736) through the high frequency power source (739) to cause plasma discharge between the two electrodes to form the a-C charge transporting layer (2) having a thickness of 5 to 50 micron meter on a previously heated Al substrate plate (752). The ratios of $n_1/n_2$ and $n_3/n_4$ specified in the embodiments of the present invention are controlled by applying a bias electric power of 10 V to 1 KV from the direct electric power source (743) though depended on other production conditions. That is, the number of saturated carbon bonding with hydrogen, and the number of the unsaturated carbon bonding with hydrogen atoms in an a-C layer are decreased by applying a high bias electric power, and the hardness of the a-C layer itself can be increases by the same. The a-C charge transporting layer formed by the above process is excellent in a transmittance, a dark resistance, and a transportability of charge carrier remarkably. The polarity of this layer may be controlled to P or N type by introducing $B_2H_6$ gas from No. 4 tank (704) or $PH_3$ gas from No. 5 tank (705) to increase the charge transportability.

The charge generating layer (3) may be produced by introducing $H_2$ gas from No. 2 tank (702) and $SiH_4$ gas from No. 3 tank (703) as a layer essentially consisting of a-Si.

When the compounds introduced into the reaction chamber (733) for the formation of a charge transporting layer is a liquid material, the gas may be introduced into the chamber (733) to cause plasma-polymerization.

In the case that the a-C layer is made from organic compounds having a high boiling point, these compounds are previously coated on the surface of the substrate, and then plasma of a carrier gas or others are irradiated on the substrate to polymerize them (so-called plasma-polymerization).

In the plasma-polymerization of a-C layer of the present invention electromagnetic wave such as laser beam, ultraviolet, X-ray or electron beam may be irradiated alone or as a supplement (photo-assist method), or the assistance of magnetic field or bias direct electric field may be effectively used. The photo-assist method is effective to quicken the deposition rate of the a-C layer, to shorten the production time and to increase the hardness of the a-C layer.

Though the main application of the a-C layer of the present invention is to a charge transporting layer as aforementioned, the a-C layer of the present invention may be used for an overcoat layer having a charge transportability. Even in the case that the a-C layer of the present invention is applied to an overcoat layer alone, an excellent durability, of course, can be achieved without increase of residual potential.

This invention will now be explained with reference to examples hereunder.

EXAMPLE 1

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_4$ gas from No. 1 tank (701) and $H_2$ gas from No. 2 tank (702) were led, under output pressure gage reading of 1 $Kg/cm^2$, into mass flow controllers (713) and (714). Then, the mass flow controllers were set so as to make $C_2H_4$ flow at 30 sccm and $H_2$ flow at 60 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of $2\times50\times50$ mm, was preliminarily heated up to 250° C., and while the gas flows and the internal pressure were stabilized, it was connected to the high frequency power source (739) and 100 watts power (frequency: 13.56 MHz) was applied to the power-applying electrode (736). After plasma polymerization for approximately four hours, there was formed a charge transporting layer with a thickness of approximately 6 microns on the conductive substrate (752).

From the analysis of the plasma polymerized polyethylene layer by Fourier transform infrared absorption spectroscope (made by Perkin Elmer), $^{13}C$-NMR analyzer (made by Nippon Denshi K.K.: solid NMR), and $^{1}H$-NMR analyzer (made by Nippon Denshi K.K.: solid NMR) the ratio of the number of saturated carbon ($n_1$) linking with hydrogen to the number of saturated carbon ($n_2$) not linking with hydrogen was 1:0.29. The dark resistance of the layer was less than $5\times10^{12}$ ohm cm and the ratio of the dark resistance to the light resistance was more than $10^2$–$10^4$. Therefore, it is understandable that this plasma polymerized polyethylene layer can be used as a photosensitive member for electrophotography.

(II) Formation of a charge generating layer

The power application from the high frequency power source (739) was stopped for a time and the reaction chamber was vacuumized inside.

By opening No. 3 and No. 2 regulating valves (709) and (708), $SiH_4$ gas from No. 3 tank (703) and $H_2$ gas from No. 2 tank (702) were, under output pressure gage reading of 1 $kg/cm^2$, led into the mass flow controllers (715) and (714). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 30 W power (frequency: 13.56 MHz) was applied to the power-applying electrode (736) to generate glow discharge. After 10 minutes of glow discharge, there was formed an a-Si:H charge generating layer with a thickness of 1 micron.

(III) Test of property of photosensitive member

Figure 15:
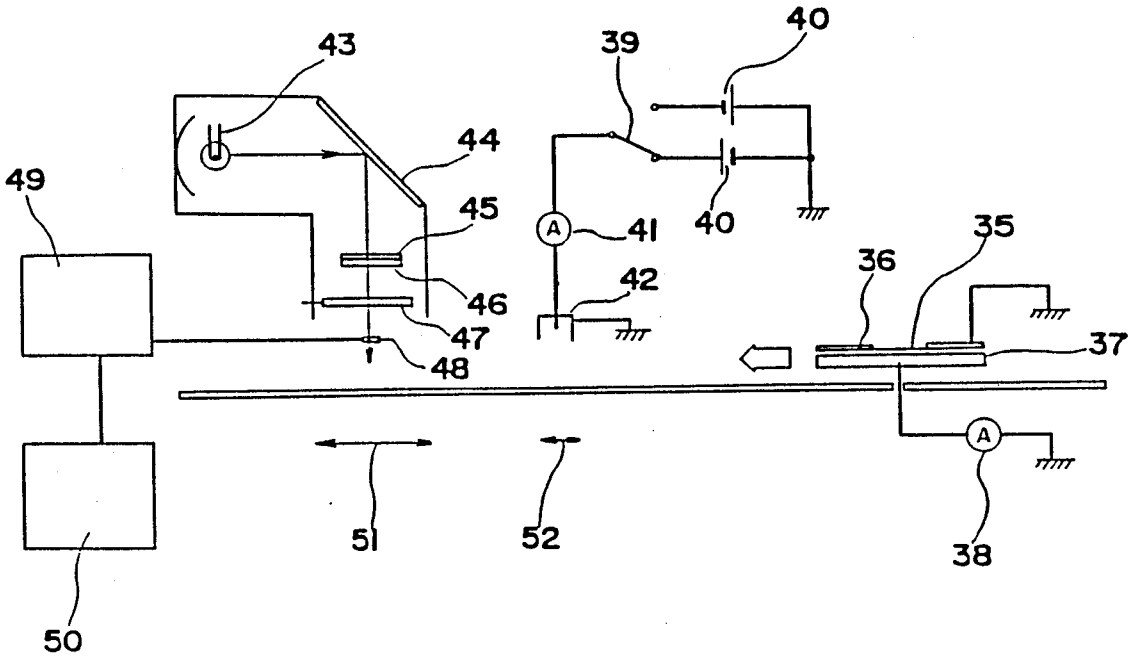
FIG. 15 shows a schematic view of a tester for the evaluation of a photosensitive member.

The photosensitive member produced according to the above processes (I) and (II) was evaluated in its chargeability and sensitivity using the tester for photosensitive member as illustrated in FIG. 15.

The sample of the photosensitive member produced (35) was put on the scanning table (37), and fixed by the shield cover (36). The scanning table (37) was moved to the charged area (52), and a high electric power supplied from the direct high electric power (40) of +7.7 KV was applied to the charger (42) to generate corona discharge on the surface of the photosensitive member, and then the scanning table (37) was moved to the discharge area (51). The surface potential of the corona discharged sample was sensed by the transparent electrode (48) to be indicated on the surface potential meter (49), and then put out on the recorder (50). The photosensitive member of the above showed an excellent chargeability.

Further, the shutter (47) was opened to irradiate the light from the halogen lump (43), which was reflected on the mirror (44), on the surface of the charged sample (35). The irradiation was effected through the transparent electrode (48), and the change of the surface potential by the irradiation was put out on the recorder (50) as well as the electric current at the same time was sensed by the photo-electric current monitor (38). The photosensitive member of the above showed a half-reduced exposure value $E_{\frac{1}{2}}$ of about 0.5 lux.sec for an initial surface potential ($V_0$) of −510 volt.

Furthermore, a drum type of a photosensitive member was made in the same manner as the Example 1 excepting that the electric power of 250 W, the flow ratio of $C_2H_4$ of 300 sccm, and the flow ratio of $H_2$ of 650 sccm were used as the condition of the production for the charge transporting layer, and the electric power of 250 W, $SiH_4$ of 180 sccm and $H_2$ of 500 sccm were used as the condition for the charge generating layer.

A simulation test for a copying process was made using a tester of drum type photosensitive member (not shown). There was obtained a stable static electric property even after the repeat of 50000 times of full copying process (charge - exposure - transferring and charge for removal - erasing).

Comparative Example 1

Instead of the plasma-polymerized polyethylene layer produced by the process (I) of the Example 1 a low density polyethylene layer in which the ratios of $n_1/n_2$ was $1:5\times10^{-3}$ ($n_1:n_2=1:5\times10^{-3}$) was produced in the thickness of 6 micron meter by a conventional organic polymerization, on which a-Si layer was deposited according to the process (II) of the Example 1. The polyethylene layer thus obtained was an insulator having an electric resistance of about $10^{16}$ ohm cm.

In the obtained polyethylene layer little unsaturated carbon was detected by IR spectrum and $^{13}$C-NMR. That is, the number of unsaturated carbon is only about 0.1% i.e. out of the range of 5 to 50%.

As the result of the test (III) the obtained photosensitive member had no photosensitivity and was charged up by several times use, which could not be applied to an electrophotography.

Comparative Example 2

Using the equipment in Example 1 as varying the conditions such as the plasma condition, plasma polymerizing polyethylene layers were produced. However, it was impossible to make an a-C layer having $n_2$ of more than 0.5, when assuming that $n_1$ is 1. Even if such a layer could be produced, a charge generating layer could not be formed on the layer, or the polyethylene layers became so soft or sticky that they could not be used as materials for a photosensitive member.

Comparative Example 3

A photosensitive member comprising an a-Si layer alone on an aluminum substrate was produced in a similar manner as in the Example 1, which a-Si layer was formed for 3.25 hours at the thickness of 6.5 micron meters.

The obtained photosensitive member had a half reduced-exposure value $E_{\frac{1}{2}}$ of about 2.7 lux.sec for an initial surface potential (Vo) of −100 V, and a sufficient chargeability could not be obtained at plus polarity.

EXAMPLE 2

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_2$ gas from No. 1 tank (701) and $H_2$ gas from No. 2 tank (702) were led, under output pressure gage reading of 1 Kg/cm$^2$, into mass flow controllers (713) and (714). Then, the mass flow controllers were set so as to make $C_2H_2$ flow at 70 sccm and $H_2$ flow at 80 sccm, and the gases were allowed into the reaction chamber (733). After the respective flows had stabilized, the internal pressure of the reaction chamber (733) was adjusted to 1.0 Torr. On the other hand, the electrically conductive substrate (752), an aluminum plate of 2×50×50mm, was preliminarily heated up to 200° C., and while the gas flows and the internal pressure were stabilized, it was connected to the high frequency power source (739) and 90 watts power (frequency: 13.56 MHz) was applied to the power-applying electrode (736). After plasma polymerization for approximately 1.5 hours, there was formed a charge transporting layer with a thickness of approximately 9 microns on the conductive substrate (752).

The ratio ($n_1:n_2$) of the obtained a-C layer was 1:0.21.

(II) Formation of a charge generating layer

The power application from the high frequency power source (739) was stopped for a time and the reaction chamber was vacuumized inside.

By opening No. 4 and No. 2 regulating valves (710) and (708), $SiH_4$ gas from No. 4 tank (704) and $H_2$ gas from No. 2 tank (702) were, under output pressure gage reading of 1 Kg/cm$^2$, led into the mass flow controllers (716) and (714). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and 30 W power (frequency: 13.56 MHz) was applied to the power-applying electrode (736) to generate glow discharge. After 10 minutes of glow discharge, there was formed an a-Si:H charge generating layer with a thickness of 1 micron.

The photosensitive member thus obtained showed a half-reduced exposure value $E_{\frac{1}{2}}$ of 0.5 lux.sec for the initial surface potential (Vo)=−460 volt. This photosensitive member, tested for the image transfer, produced clear images.

EXAMPLE 3

(I) Formation of an a-C layer

In a system of glow discharge decomposition with equipment as illustrated in FIG. 13, first the reaction chamber (733) was vaccumized inside to a high level of approximately $10^{-6}$ Torr, and then by opening No. 1, No. 2 and No. 3 regulating valves (707), (708) and (709), $C_2H_4$ gas from No. 1 tank (701), $CH_4$ gas from No. 2 tank, and $H_2$ gas from No. 3 tank (703) were led, under output pressure gage reading of 1 Kg/cm$^2$, into mass flow controllers (713), (714) and (715). Then, the mass flow controllers were set so as to make $C_2H_4$ flow at 60 sccm, $CH_4$ flow at 100 sccm and $H^2$ flow at 120 accm, and the gases were allowed into the reaction chamber (733). After the respective flows had stabilized, the internal pressure of the reaction chamber (733) was adjusted to 0.8 Torr. On the other hand, the electrically conductive substrate (752), which was an aluminum plate of 2×50×50mm, was preliminarily heated up to 250° C., and while the gas flows and the internal pressure were stabilized, it was connected to the high frequency power source (739) and 200 watts power (frequency: 13.56 MHz) was applied to the power-applying electrode (736). After plasma polymerization for approximately 4 hours, there was formed a charge transporting layer with a thickness of approximately 6 μ on the conductive substrate (752). The ratio ($n_1:n_2$) of the a-C layer was 1:0.39.

A charge generating layer was formed on the a-C layer in the same manner as in Example 2(II) to give a photosensitive member.

The photosensitive member thus obtained showed a half-reduced exposure value $E_{\frac{1}{2}}$ of 1.5 lux.sec for the initial surface potential ($V_0$)=−540 volt. This photosensitive member, tested for the image transfer, produced clear images.

EXAMPLE 4

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 -No. 3 regulating valves (707)-(709), $C_2H_4$ gas from No. 1 tank (701), $CH_4$ gas from No. 2 tank (702) and $H_2$ gas from No.3 tank (703) were led, under output pressure gage reading of 1 Kg/cm$^2$, into mass flow controllers (713)-(715). Then, the mass flow controllers were set so as to make $C_2H_4$ flow at 55 sccm, $CH_4$ flow at 60 sccm, and $H_2$ flow at 100 sccm, and the gases were allowed into the reaction chamber (733). After the respective flows had stabilized, the internal pressure of the reaction chamber (733) was adjusted to 1.5 Torr. On the other hand, the electrically conductive substrate (752), which was an aluminum plate of 2×50×50mm, was preliminarily heated up to 250° C., and while the gas flows and the internal pressure were stabilized, it was connected to the high frequency power source (739) and 200 watts power (frequency: 13.56 MHz) was applied to the power-applying electrode (736). After plasma polymerization for approximately 5 hours, there was formed a charge transporting layer with a thickness of approximately 5 microns on the conductive substrate (752).

The ratio ($n_1$:$n_2$) of the obtained a-C layer was 1:0.18.

A charge generating layer was formed on the a-C layer in the same manner as in Example 2(II) to give a photosensitive member.

The photosensitive member thus obtained showed a half-reduced exposure value $E_{\frac{1}{2}}$ of 1.9 lux.sec for the initial surface potential (Vo)=−530 volt. This photosensitive member, tested for the image transfer, produced clear images.

EXAMPLE 5

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 6 and No. 7 regulating valves (712) and (725), $H_2$ gas from No. 6 tank (706) under output pressure gage reading of 1 Kg/cm$^2$, and stylene gas from No. 1 vessel (719) that was heated at about 50° C. by No. 1 heater (722) were led into mass flow controllers (718) and (728). Then, the mass flow controllers were set so as to make $H_2$ flow at 30 sccm and stylene flow at 50 sccm, and the gases were allowed into the reaction chamber (733). After the respective flows had stabilized, the internal pressure of the reaction chamber (733) was adjusted to 0.3 Torr. On the other hand, the electrically conductive substrate (752), which was an aluminum plate of 2×50×50 mm, was preliminarily heated up to 150° C., and while the gas flows and the internal pressure were stabilized, it was connected to the low frequency power source (736) and 150 watts power (frequency: 30 KHz) was applied to the power-applying electrode (736). After plasma polymerization for approximately 35 minutes, there was formed a charge transporting layer with a thickness of approximately 8 microns on the conductive substrate (752).

The ratio ($n_1$:$n_2$) of the obtained a-c layer was 1:0.15.

A charge generating layer was formed on the a-C layer in the same manner as in Example 2(II) to give a photosensitive member.

The photosensitive member thus obtained showed a half-reduced exposure value $E_{\frac{1}{2}}$ of 5.9 lux.sec for the initial surface potential (Vo)=−650 volt. This photosensitive member, tested for the image transfer, produced clear images.

EXAMPLE 6

Using the vapor deposition equipment of FIG. 14, titanyl phthalocyanine was deposited on an aluminum substrate under a vacuum of not more than $1\times10^{-5}$ Torr, and a boat temperature of 400° to 600° C. The obtained titanyl phthalocyanine layer had a thickness of 600 angstrom.

On the titanyl phthalocyanine layer, an a-C layer was formed in the same manner as in the process of Example 5 (I) to give a photosensitive member. The ratio ($n_1$:$n_2$) of the a-C layer was 1:02, and the photosensitive member obtained showed a half-reduced exposure value $E_{\frac{1}{2}}$ of 6.0 lux.sec for the initial surface potential (Vo)=550 V, the sensitivity of $E_{\frac{1}{2}}$ of 15.4 erg/cm$^2$ under semiconductor laser of 780 nm.

The charge transporting layer produced by the same manner as the above was formed on the charge generating layer made of amorphous Se-Te and Se-As having a thickness of 1.2 micron meter each. The obtained photosensitive member had excellent properties for an electrophotography.

EXAMPLE 7

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_4$ gas from No. 1 tank (701) and $H_2$ gas from No. 2 tank (702) were led, under output pressure gage reading of 1 Kg/cm$^2$, into mass flow controllers (713) and (714). Then, the mass flow controllers were set so as to make $C_2H_4$ flow at 30 sccm and $H_2$ flow at 65 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of 2×50×50 mm, was preliminarily heated up to 250° C., and while the gas flows and the internal pressure were stabilized, it was connected to the high frequency power source (739) and 100 watts power (frequency: 13.56 MHz) was applied to the power-applying electrode (736). After plasma polymerization for approximately four hours, there was formed a charge transporting layer with a thickness of approximately 6 microns on the conductive substrate (752).

The ratio of the number of unsaturated carbon atoms ($n_3$) linking with hydrogen to the number of unsaturated carbon stoms ($n_4$) not linking with hydrogen was 1:0.89. The dark resistance of the layer was less than about $1\times10^{12}$ Ω.cm and the ratio of the dark resistance to the light resistance was more than $10^2$–$10^4$. Therefore, it is understandable that this plasma polymerized polyethylene layer can be used as a photosensitive member for electrography.

(II) Formation of a charge generating layer

The power application from the high frequency power source (739) was stopped for a time and the reaction chamber was vacuumized inside.

By opening No. 3 and No. 2 regulating valves (709) and (708), $SiH_4$ gas from No. 3 tank (703) and $H_2$ gas from No. 2 tank (702) were, under output pressure gage reading of 1 $Kg/cm^2$, led into the mass flow controllers (715) and (714). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 30 W power (frequency: 13.56 MHz) was applied to the power-applying electrode (736) to generate glow discharge. After 10 minutes of glow discharge, there was formed an a-Si:H charge generating layer with a thickness of 1 micron.

The photosensitive member thus obtained was evaluated in the same manner as in Example 1 (III), and showed a half-reduced exposure value $E_{\frac{1}{2}}$ of 0.7 lux.sec for the initial surface potential (Vo)= −495 volt. This photosensitive member, tested for the image transfer, produced clear images.

Comparative Example 4

In a system of glow discharge decomposition with equipment as illustrated in FIG. 13, first the reaction chamber (733) was vacuumized inside to a high level of approximately $10^{-6}$ Torr, and then aloxymene gas was led to No. 7 flow controller (728) from No. 1 vessel (719) as heating by No. 1 heater (722) at 100° C., and as making the gas flow at 20 sccm to be allowed into the reaction chamber (733) through the mixer (731) and the main pipe (732).

After the reaction flow had stabilized, the internal pressure of the reaction chamber (733) was adjusted to 1.5 Torr by the pressure controlling valve (745). On the other hand, the electrically conductive substrate (752), which was an aluminum plate of 3×50×50 mm, was preliminarily heated up to 180° C., and while the gas flows and the internal pressure were stabilized, it was connected to the low frequency power source (741), which was previously contacted with the selection switch (744) and 120 watts power (frequency: 35 KHz) was applied to the power-applying electrode (736). After plasma polymerization for approximately 2 hours and 40 minutes, there was formed a charge transporting layer with a thickness of approximately 15 microns on the conductive substrate (752). After the layer-formation, the power applying was stopped, the control valve was closed, and then the reaction chamber (733) was sufficiently discharged.

The obtained a-C layer was analyzed with ONH analysis using EMGA-1300 (available from Horiba Seisakusho). The content of the hydrogen atom in the a-C layer was 23 atomic % based on the total amount of the hydrogen atoms and the carbon atoms, and the ratio ($n_3$:$n_4$) of the a-C layer was 1:5.2.

(II) Formation of a charge generating layer

By opening No. 1 and No. 6 regulating valves (707) and (712), $H_2$ gas from No. 1 tank (701) and $SiH_4$ gas from No. 6 tank (706) were, under output pressure gage reading of 1 $Kg/cm^2$, led into the mass flow controllers (713) and (718). Then, the mass flow controllers were set so as to make $H_2$ flow at 200 sccm and $SiH_4$ flow at 100 sccm, and the gases were allowed into the reaction chamber (733). After the respective flows had stabilized, the internal pressure of the reaction chamber (733) was adjusted to 0.8 Torr.

While the substrate, on which a-C layer was formed, was heated to 250° C., and the gas flow and the pressure were stabilized, the circuit to the high frequency power source (739) was supplied and 35 W power (frequency: 13.56 MHz) was applied to generate glow discharge. After 5 minutes of glow discharge, there was formed an a-Si:H charge generating layer with a thickness of 0.3 μ.

The photosensitive member thus obtained showed a high maximum charged potential of −800 V, but a half-reduced exposure value $E_{\frac{1}{2}}$ of 17 lux.sec, which means the photosensitivity remarkably decreases in the case of the ratio ($n_1$:$n_2$) being 1: more than 4.

Comparative Example 5

A plasma polymerized polyethylene layer having a ratio of $n_3$:$n_4$ of 1:0.18 with a thickness of 5.5 micron meter was obtained in the same manner as in Example 7 excepting that the flow rates of $C_2H_4$ and $H_2$ were 100 sccm and 180 sccm respectively, the internal pressure of the reaction chamber was 1.2 Torr, applied power was 230 watts, and reaction time was 5 hours at the production of a-C layer.

The a-Si layer with a thickness of 1 micron meter was formed in the same manner as in Example 7.

The obtained photosensitive member was evaluated in the same manner as in Example 1 (III), and showed a half-reduced exposure value $E_{\frac{1}{2}}$ of 10.5 lux.sec for the initial surface potential (Vo)= −610 volt.

EXAMPLE 8

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_2$ gas from No. 1 tank (701) and $H_2$ gas from No. 2 tank (702) were led, under output pressure gage reading of 1 $Kg/cm^2$, into mass flow controllers (713) and (714). Then, the mass flow controllers were set so as to make $C_2H_2$ flow at 60 sccm and $H_2$ flow at 80 sccm, and the gases were allowed into the reaction chamber (733). After the respective flows had stabilized, the internal pressure of the reaction chamber (733) was adjusted to 0.8 Torr. On the other hand, the electrically conductive substrate (752), an aluminum plate of 2×50×50mm, was preliminarily heated up to 200° C., and while the gas flows and the internal pressure were stabilized, it was connected to the high frequency power source (739) and 85 watts power (frequency: 13.56 MHz) was applied to the power-applying electrode (736). After plasma polymerization for approximately 1.2 hours, there was formed a charge transporting layer with a thickness of approximately 10 microns on the conductive substrate (752).

The ratio ($n_3$:$n_4$) of the obtained a-C layer was 1:1.27.

(II) Formation of a charge generating layer

The power application from the high frequency power source (739) was stopped for a time and the reaction chamber was vacuumized inside.

By opening No. 4 and No. 2 regulating valves (710) and (708), $SiH_4$ gas from No. 4 tank (704) and $H_2$ gas from No. 2 tank (702) were, under output pressure gage reading of 1 $Kg/cm^2$, led into the mass flow controllers (716) and (714). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 30 W power (frequency: 13.56 MHz) was applied to the power-applying electrode (736) to generate glow discharge. After 10 minutes of glow discharge, there was formed an a-Si:H charge generating layer with a thickness of 1 micron.

The photosensitive member thus obtained showed a half-reduced exposure value $E_{\frac{1}{2}}$ of 0.5 lux.sec for the initial surface potential (Vo)= −490 volt. This photosensitive member, tested for the image transfer, produced clear images.

EXAMPLE 9

(I) Formation of an a-C layer

In a system of glow discharge decomposition with equipment as illustrated in FIG. 13, first the reaction chamber (733) was vaccumized inside to a high level of approximately $10^{-6}$ Torr, and then by opening No. 1 -No. 3 regulating valves (707)-(709), $C_2H_4$ gas from No. 1 tank (701), $CH_4$ gas from No. 2 tank (702), and $H_2$ gas from No. 3 tank (703) were led, under output pressure gage reading of 1 Kg/cm$^2$, into mass flow controllers (713), (714) and (715). Then, the mass flow controllers were set so as to make $C_2H_4$ flow at 45 sccm, $CH_4$ flow at 100 sccm, and $H_2$ flow at 120 accm, and the gases were allowed into the reaction chamber (733). After the respective flows had stabilized, the internal pressure of the reaction chamber (733) was adjusted to 1.0 Torr. On the other hand, the electrically conductive substrate (752), which was an aluminum plate of 2×50×50mm, was preliminarily heated up to 250° C., and while the gas flows and the internal pressure were stabilized, it was connected to the high frequency power source (739) and 250 watts power (frequency: 13.56 MHz) was applied to the power-applying electrode (736). After plasma polymerization for approximately 5 hours, there was formed a charge transporting layer with a thickness of approximately 6 μ on the conductive substrate (752). The ratio ($n_3$:$n_4$) in the obtained a-C layer was 1:0.52.

On the a-C layer, a charge generating layer was formed in the same manner as in Example 2(II) to give a photosensitive member.

The photosensitive member thus obtained showed a half-reduced exposure value $E_{\frac{1}{2}}$ of 1.5 lux.sec for the initial surface potential ($V_0$)= −520 volt. This photosensitive member, tested for the image transfer, produced clear images.

EXAMPLE 10

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 1 -No. 3 regulating valves (707)-(709), $C_2H_4$ gas from No. 1 tank (701), $CH_4$ gas from No. 2 tank (702) and $H_2$ gas from No.3 tank (703) were led, under output pressure gage reading of 1 Kg/cm$^2$, into mass flow controllers (713)-(715). Then, the mass flow controllers were set so as to make $C_2H_4$ flow at 60 sccm, $CH_4$ flow at 60 sccm, and $H_2$ flow at 100 sccm, and the gases were allowed into the reaction chamber (733). After the respective flows had stabilized, the internal pressure of the reaction chamber (733) was adjusted to 1.5 Torr. On the other hand, the electrically conductive substrate (752), an aluminum plate of 2×50×50mm, was preliminarily heated up to 250° C., and while the gas flows and the internal pressure were stabilized, it was connected to the high frequency power source (739) and 200 watts power (frequency: 13.56 MHz) was applied to the power-applying electrode (736). After plasma polymerization for approximately 5 hours, there was formed a charge transporting layer with a thickness of approximately 5 microns on the conductive substrate (752).

The ratio ($n_3$:$n_4$) of the obtained a-C layer was 1:2.1.

A charge generating layer was formed on the a-C layer in the same manner as in Example 8(II) to give a photosensitive member.

The photosensitive member thus obtained showed a half-reduced exposure value $E_{\frac{1}{2}}$ of 1.8 lux.sec for the initial surface potential ($V_0$)= −530 volt. This photosensitive member, tested for the image transfer, produced clear images.

EXAMPLE 11

(I) Formation of an a-C Layer

In a system of glow discharge decomposition with equipment as illustrated in FIG. 13, first the reaction chamber (733) was vacuumized inside to a high level of approximately $10^{-6}$ Torr, and then by opening No. 6 and No. 7 regulating valves (712) and (725), $H_2$ gas from No. 6 tank (706) under output pressure gage reading of 1 Kg/cm$^2$, and stylene gas from No. 1 vessel (719) that was heated at about 50° C. by No. 1 heater (722) were led into mass flow controllers (718) and (728). Then, the mass flow controllers were set so as to make $H_2$ flow at 30 sccm and stylene flow at 50 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of 2×50×50 mm, was preliminarily heated up to 150° C., and while the gas flows and the internal pressure were stabilized, it was connected to the low frequency power source (736) and 150 watts power (frequency: 30 KHz) was applied to the power-applying electrode (736). After plasma polymerization for approximately 50 minutes, there was formed a charge transporting layer with a thickness of approximately 8 microns on the conductive substrate (752).

The ratio ($n_3$:$n_4$) of the a-C layer was 1:0.33.

A charge generating layer was formed on the a-C layer according to the same manner as in Example 2(II) to give a photosensitive member.

The photosensitive member thus obtained showed a half-reduced exposure value $E_{\frac{1}{2}}$ of 4.0 lux.sec for the initial surface potential (Vo)= −620 volt. This photosensitive member, tested for the image transfer, produced clear images.

EXAMPLE 12

Using the vapor deposition equipment of FIG. 14, titanyl phthalocyanine was deposited on an aluminum substrate under a vacuum of not more than $1\times10^{-5}$ Torr, and a boat temperature of 400° to 600° C. The obtained titanyl phthalocyanine layer had a thickness of 600 angstrom.

On the titanyl phthalocyanine layer, an a-C layer was formed in the same manner as in the process of Example 11 (I) to give a photosensitive member. The ratio ($n_3$:$n_4$) of the a-C layer was 1:1.0, and the photosensitive member obtained showed a half-reduced exposure value $E_{\frac{1}{2}}$ of 6.0 lux.sec for the initial surface potential (Vo)=550 V, the sensitivity of $E_{\frac{1}{2}}$ of 15.4 erg/cm$^2$ under semiconductor laser of 780 nm.

The charge transporting layer produced by the same manner as the above was formed on the charge generating layer made of amorphous Se-Te and Se-As having a thickness of 1.2 micron meter each. The obtained photosensitive member had excellent properties for electrophotography.

What is claimed is:

1. A photosensitive member comprising:
an electrically conductive substrate;
a charge generating layer; and
a charge transporting layer comprising amorphous carbon containing hydrogen and having a thickness of about 5 to about 50 microns, said amorphous carbon comprising saturated carbon $n_1$ linked with hydrogen and saturated carbon $n_2$ free from linking with hydrogen, the ratio of the number $n_1$ to that of $N_2$ being 1:0.5 to 1:0.14, said hydrogen being contained in an amount of 20 to 67 atomic %.

2. A photosensitive member as claimed in claim 1 wherein said ratio of the amount of $N_1$ to that of $N_2$ is preferably 1:0.17 to 1:0.4.

3. A photosensitive member as claimed in claim 1 wherein said amorphous carbon includes saturated carbon in an amount of 40 to 90% based on all carbon atoms.

4. A photosensitive member as claimed in claim 1 wherein said saturated carbon $N_1$ and $N_2$ include neocarbon methine methylene or methyl.

5. A photosensitive member comprising:
an electrically conductive substrate;
a charge generating layer; and
a charge transporting layer comprising amorphous carbon containing hydrogen and having a thickness of about 5 to about 50 microns, said amorphous carbon comprising unsaturated carbon $n_3$ linked with hydrogen and unsaturated carbon $N_4$ free from linking with hydrogen, the ratio of the number $N_3$ to that of $N_4$ being 1:4 to 1:0.2, said hydrogen being contained in an amount of 20 to 67 atomic %.

6. A photosensitive member as claimed in claim 5 wherein said ratio of the number of $N_3$ to that of $N_4$ is preferably 1:2 to 1:0.5.

7. A photosensitive member as claimed in claim 5 wherein said amorphous carbon includes unsaturated carbon in an amount of 5 to 50% based on all carbon atoms.

* * * * *